US011814210B1

(12) United States Patent
Benson

(10) Patent No.: US 11,814,210 B1
(45) Date of Patent: Nov. 14, 2023

(54) DUAL MOUTH SHOTGUN CAN

(71) Applicant: Ryan Benson, Irvine, CA (US)

(72) Inventor: Ryan Benson, Irvine, CA (US)

( * ) Notice: Subject to any disclaimer, the term of this patent is extended or adjusted under 35 U.S.C. 154(b) by 0 days.

(21) Appl. No.: 18/197,170

(22) Filed: May 15, 2023

(51) Int. Cl.
*B65D 17/28* (2006.01)
*B65D 17/00* (2006.01)

(52) U.S. Cl.
CPC ..... *B65D 17/4012* (2018.01); *B65D 17/02* (2013.01); *B65D 17/402* (2018.01); *B65D 2517/0008* (2013.01); *B65D 2517/0014* (2013.01)

(58) Field of Classification Search
CPC .... B65D 15/02; B65D 15/06; B65D 2543/00; B65D 2517/00
USPC ..... 221/102; 220/269, 600
See application file for complete search history.

(56) References Cited

U.S. PATENT DOCUMENTS 3,656,954 A * 4/1972 Thiers ..... G03C 1/95 430/536
3,982,651 A * 9/1976 Braun ..... B65D 41/17 220/288
2004/0129704 A1* 7/2004 Battmer ..... B65D 17/4012 220/269
2009/0050637 A1* 2/2009 Shetty ..... B65D 17/34 426/115
2016/0029846 A1* 2/2016 Zickler ..... B65D 81/3205 206/219
2020/0122874 A1* 4/2020 Doster ..... B65D 65/466

* cited by examiner

*Primary Examiner* — Anthony D Stashick
*Assistant Examiner* — Raven Collins
(74) *Attorney, Agent, or Firm* — Pharar Patents & Intellectual Property; Andrew A. Pharar

(57) ABSTRACT

The dual mouth shotgun can may combine the advantages of a standard aluminum beverage can with a second opening to allow for a high rate of air flow and displacement resulting in a high rate of fluid flow from the can. The can may implement a stay-tab mechanism, or any other appropriate mechanism, for ease of use and familiarity, on the standard top opening, and may further implement a stay-tab mechanism, or other appropriate mechanism on the bottom or lower side of the can for shotgunning the fluid in the can. The dual mouth shotgun can may provide a user with a single opening mechanism on its top surface for normal drinking, and a second opening mechanism on its bottom or lower side surface for drinks shotgunning. In one embodiment the can may comprise an upper and a lower body that may be twisted relative to one another to expose an opening in the side of the can that allows for drinks shotgunning. In another embodiment the can may further comprise a pushrod that leverages the second opening open when the first opening is opened. In another embodiment the can may require that the upper and lower bodies must be rotated to align outer and inner holes that then allow the pushrod to push open the second opening.

1 Claim, 11 Drawing Sheets

DUAL MOUTH SHOTGUN CAN

TECHNICAL FIELD OF THE INVENTION

The present invention relates in general to fluid containers, and, more specifically, to a dual mouth shotgun can.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

A beverage can is a, usually, metal container designed to hold a volume of volatile fluids such as carbonated soft drinks, beers, sparkling waters, sparkling wine coolers, and energy drinks. Such cans aid in keeping the fluids contained within carbonated until they are opened for drinking. Beverage cans are generally made available in metals such as aluminum or tin-plated steel for ease of manufacturing and recycling.

Most beverage cans have a single-use opening on their top surface that provides a mechanism to aid a user in opening the can. One very common type of opening is the stay-tab opening mechanism, which provides a lever arm riveted to the top of the can, and which can be lifted to press against a mouth lid having a relatively thin connection to the rest of the top. The mouth lid can be popped down into the can using the lever arm, and a user can then drink from the can. Another type of opening in use is the pop-tab or pull-tab mechanism, by which a user pulled up on the lever arm and removed the mouth lid from the top of the can.

All such mechanisms roughly employ the basic principles of fluid displacement, namely that for fluid to come out of the can it must be replaced with air. A common modification to cans in recent history was to use a wider mouth design, which allowed more air into the can for a higher rate of flow.

Another common method for increasing the air flow into a can and, thus, the fluid flow out of the can, is to puncture the can somewhere other than the mouth. The larger the opening, of course, the more fluid will flow out of the can. The act of shotgunning a beer, for example, involves a user punching a large hole into the side of a can, and then opening the can mouth to rapidly draw air into the can while expelling the beer at a very high rate of flow.

No solution exists, though, to provide a beverage can that comes pre-installed with two mouth openings and two opening mechanisms.

Thus, there is a need in the art for a dual mouth shotgun can that may provide a user with a single opening mechanism on its top surface for normal drinking, and a second opening mechanism on its bottom or lower side surface for drinks shotgunning. In one embodiment the can may comprise an upper and a lower body that may be twisted relative to one another to expose an opening in the side of the can that allows for drinks shotgunning. In another embodiment the can may further comprise a pushrod that leverages the second opening open when the first opening is opened. In another embodiment the can may require that the upper and lower bodies must be rotated to align outer and inner holes that then allow the pushrod to push open the second opening. It is to these ends that the present invention has been developed.

BRIEF SUMMARY OF THE INVENTION

To minimize the limitations in the prior art, and to minimize other limitations that will be apparent upon reading and understanding the present specification, the present invention describes a dual mouth shotgun can.

It is an objective of the present invention to provide a dual mouth shotgun can that may comprise a beverage can.

It is another objective of the present invention to provide a dual mouth shotgun can that may comprise an aluminum can.

It is another objective of the present invention to provide a dual mouth shotgun can that may comprise a top opening mechanism.

It is another objective of the present invention to provide a dual mouth shotgun can that may comprise a side opening mechanism.

It is another objective of the present invention to provide a dual mouth shotgun can that may comprise a stay-tab opening mechanism.

It is another objective of the present invention to provide a dual mouth shotgun can that may comprise a pop-tab opening mechanism.

It is another objective of the present invention to provide a dual mouth shotgun can that may comprise a wide mouth opening.

It is another objective of the present invention to provide a dual mouth shotgun can that may comprise an upper body.

It is another objective of the present invention to provide a dual mouth shotgun can that may comprise an outer opening.

It is another objective of the present invention to provide a dual mouth shotgun can that may comprise a lower body.

It is another objective of the present invention to provide a dual mouth shotgun can that may comprise a lower mouth.

It is another objective of the present invention to provide a dual mouth shotgun can that may comprise a pushrod.

It is another objective of the present invention to provide a dual mouth shotgun can that may comprise a resilient material of construction.

It is another objective of the present invention to provide a dual mouth shotgun can that may comprise a water-proof material of construction.

It is another objective of the present invention to provide a dual mouth shotgun can that may comprise a reusable material of construction.

It is another objective of the present invention to provide a dual mouth shotgun can that may comprise a washable material of construction.

It is another objective of the present invention to provide a dual mouth shotgun can that may comprise an antimicrobial layer.

It is another objective of the present invention to provide a dual mouth shotgun can that may comprise an antimicrobial material of construction.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE INVENTION

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

The dual mouth shotgun can may combine the advantages of a standard aluminum beverage can with a second opening to allow for a high rate of air flow and displacement resulting in a high rate of fluid flow from the can. The can may implement a stay-tab mechanism, or any other appropriate mechanism, for ease of use and familiarity, on the standard top opening, and may further implement a stay-tab mechanism, or other appropriate mechanism on the bottom or lower side of the can for shotgunning the fluid in the can. The dual mouth shotgun can may provide a user with a single opening mechanism on its top surface for normal drinking, and a second opening mechanism on its bottom or lower side surface for drinks shotgunning. In one embodiment the can may comprise an upper and a lower body that may be twisted relative to one another to expose an opening in the side of the can that allows for drinks shotgunning. In another embodiment the can may further comprise a pushrod that leverages the second opening open when the first opening is opened. In another embodiment the can may require that the upper and lower bodies must be rotated to align outer and inner holes that then allow the pushrod to push open the second opening.

Figure 1:
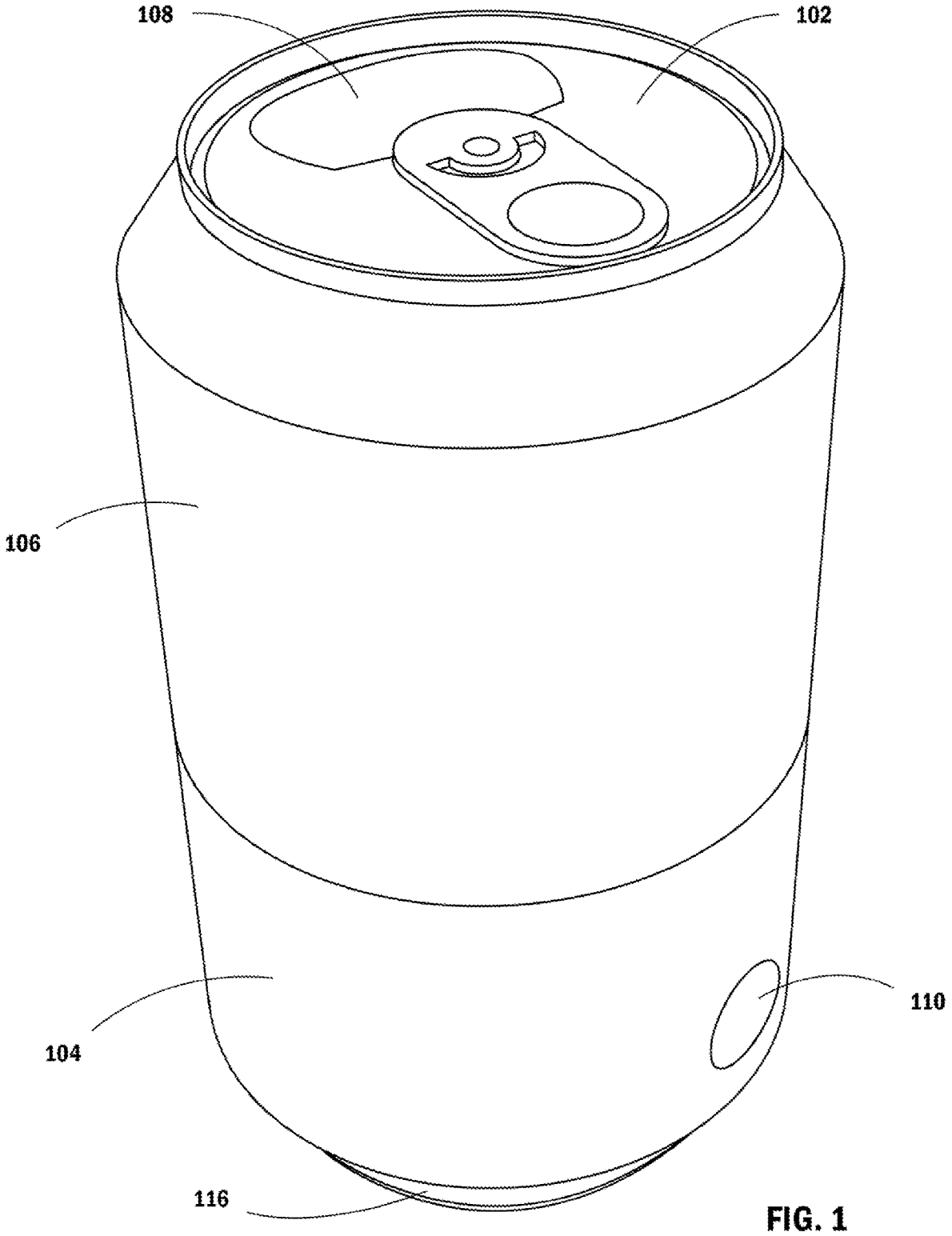
FIG. 1 is a rear isometric perspective view of a dual mouth shotgun can, as contemplated by the present disclosure.
Figure 2:
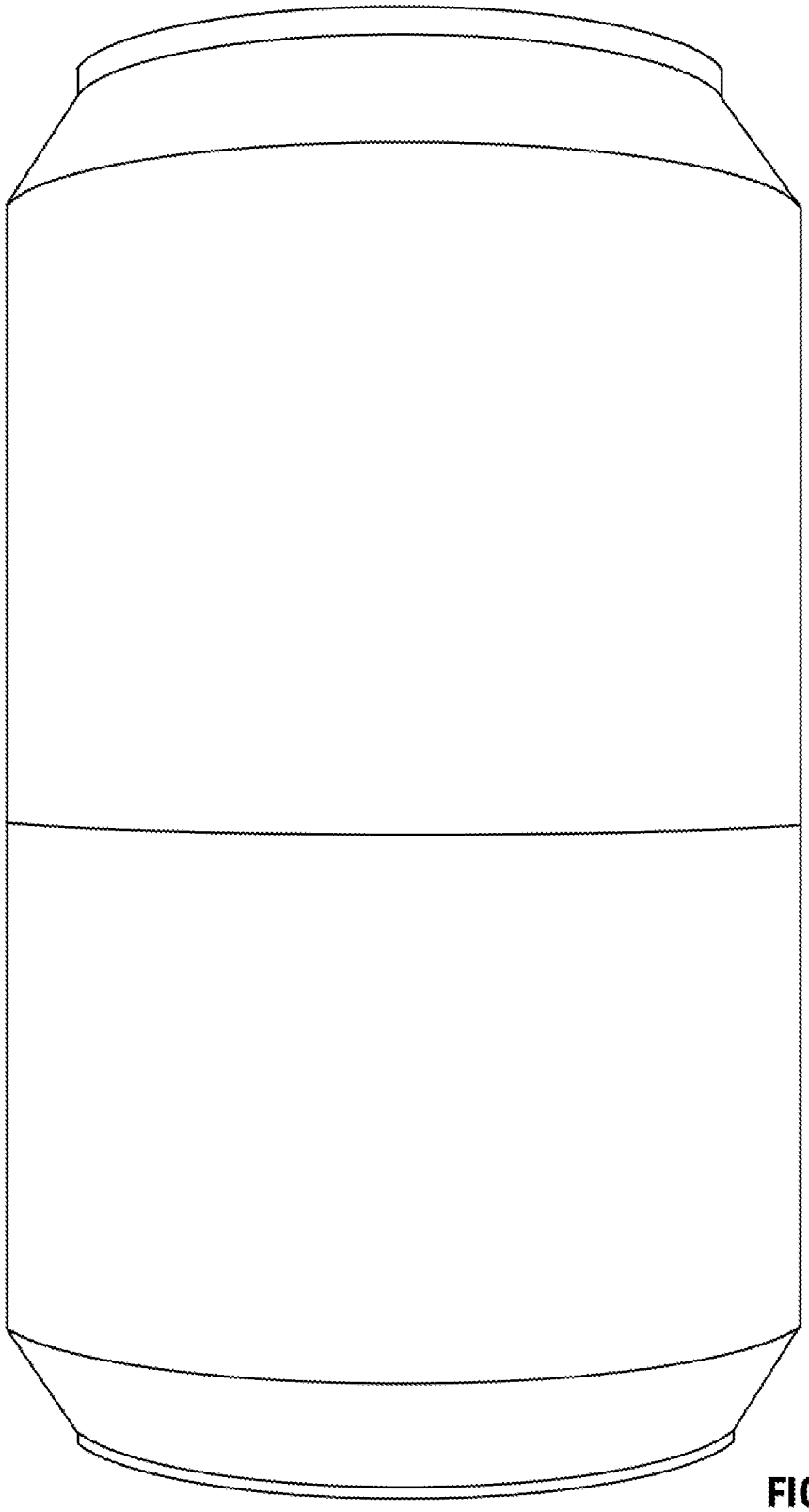
FIG. 2 is a front elevation view of a dual mouth shotgun can, as contemplated by the present disclosure.
Figure 3:
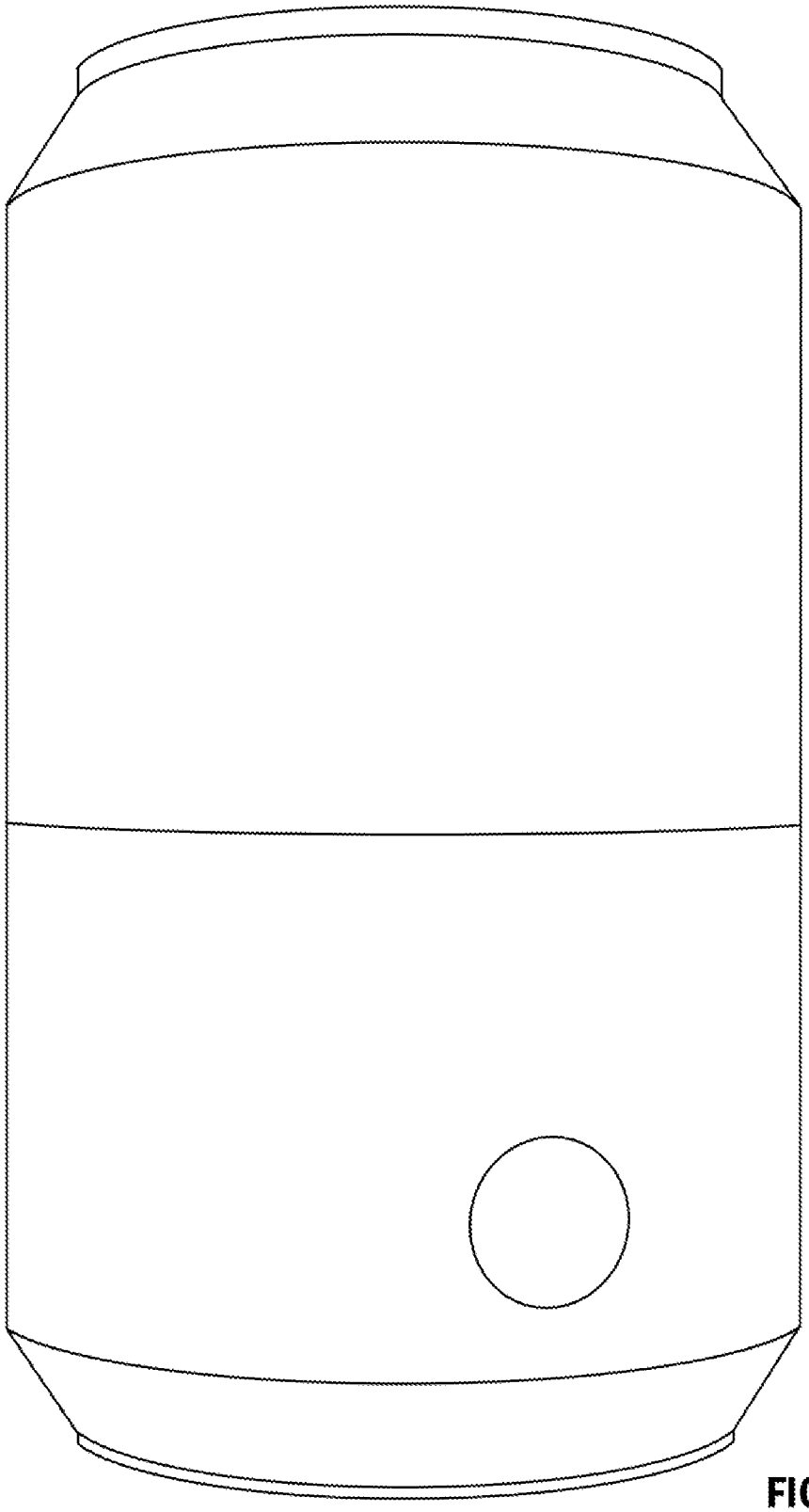
FIG. 3 is a rear elevation view of a dual mouth shotgun can, as contemplated by the present disclosure.
Figure 4:
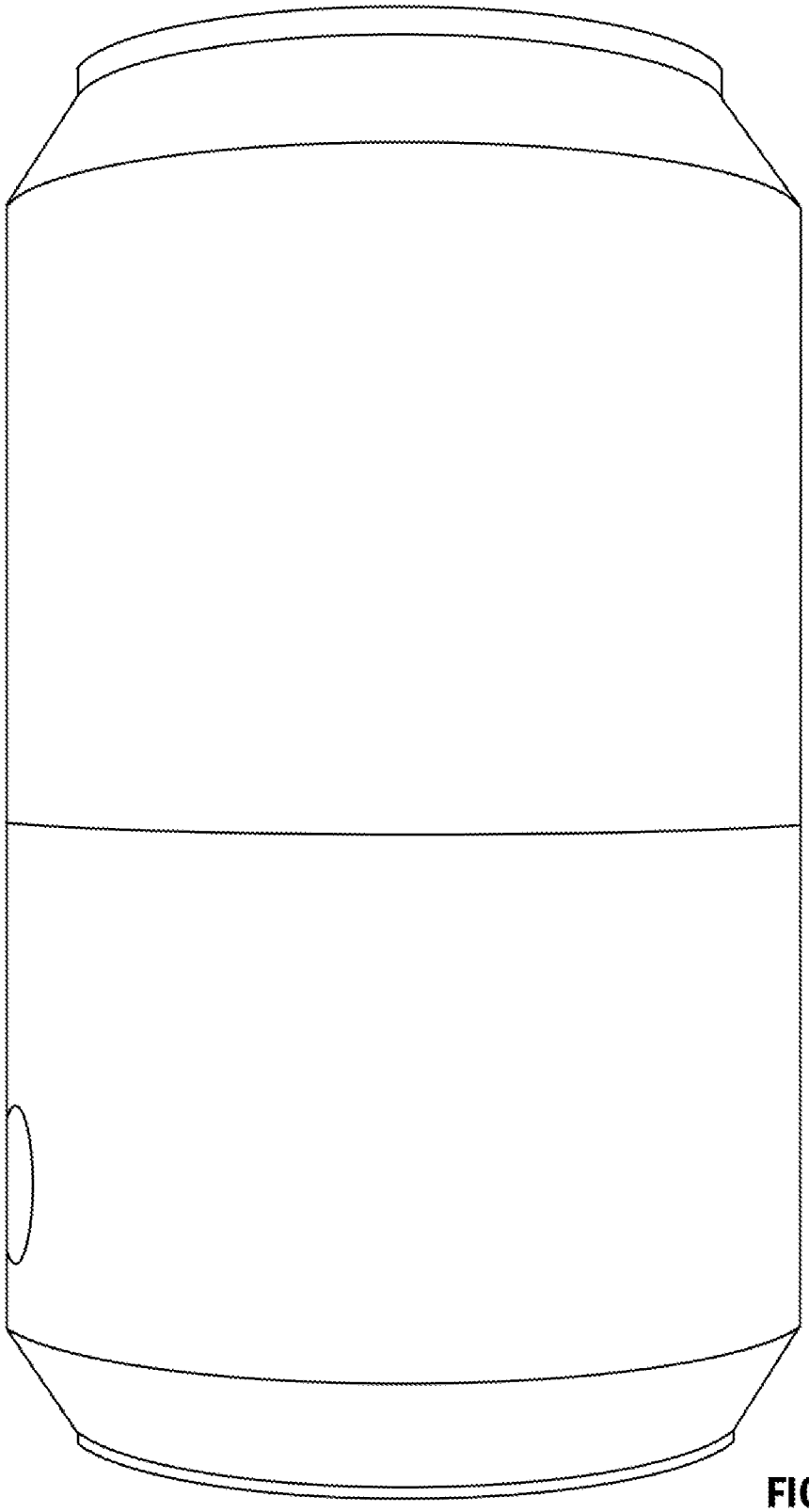
FIG. 4 is a right side elevation view of a dual mouth shotgun can, as contemplated by the present disclosure.
Figure 5:
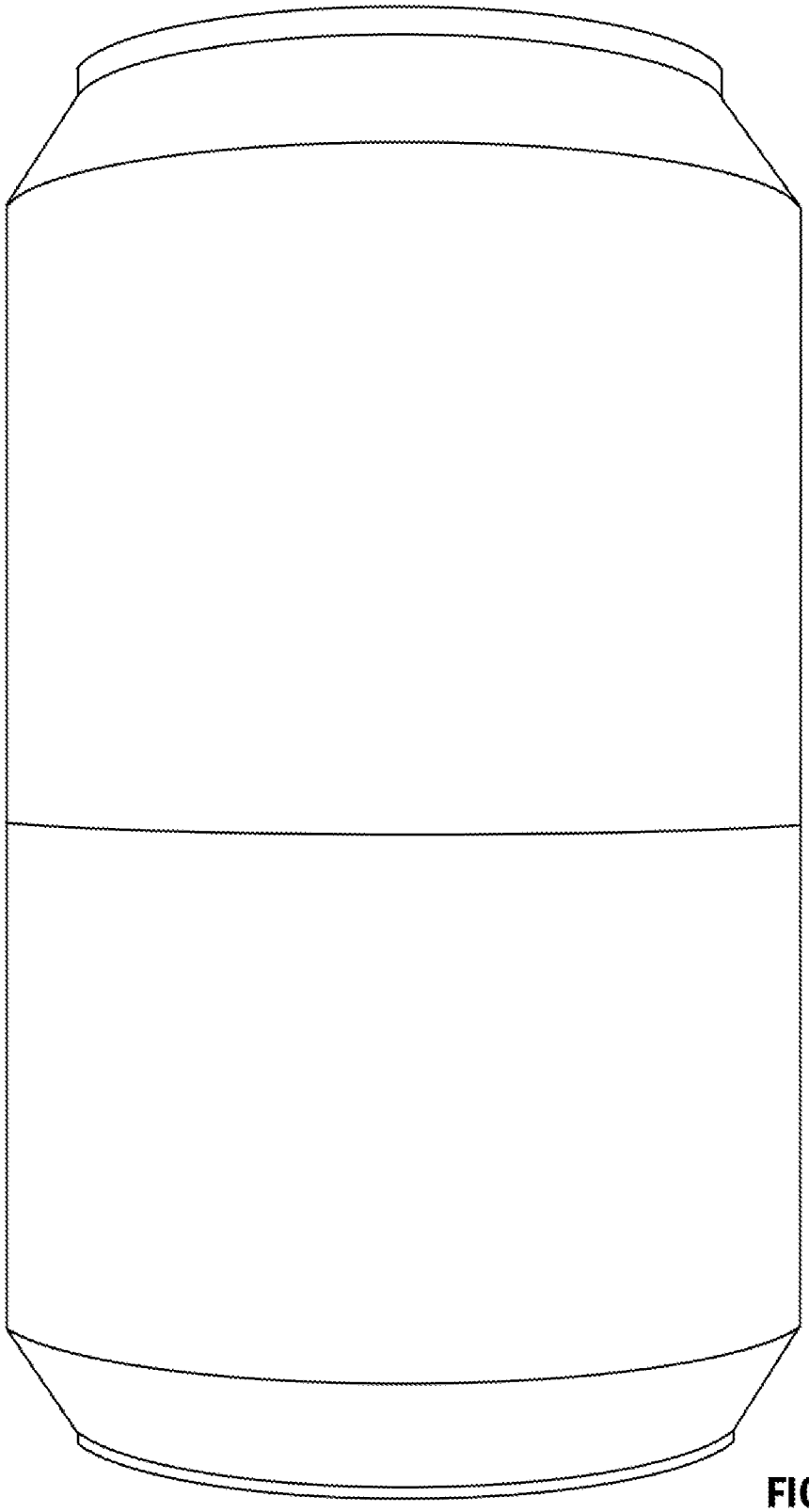
FIG. 5 is a left side elevation view of a dual mouth shotgun can, as contemplated by the present disclosure.
Figure 6:
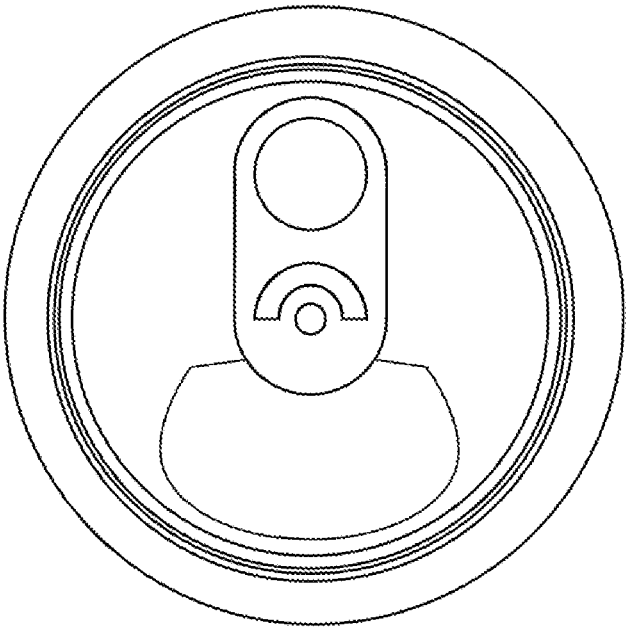
FIG. 6 is a top plan view of a dual mouth shotgun can, as contemplated by the present disclosure.
Figure 7:
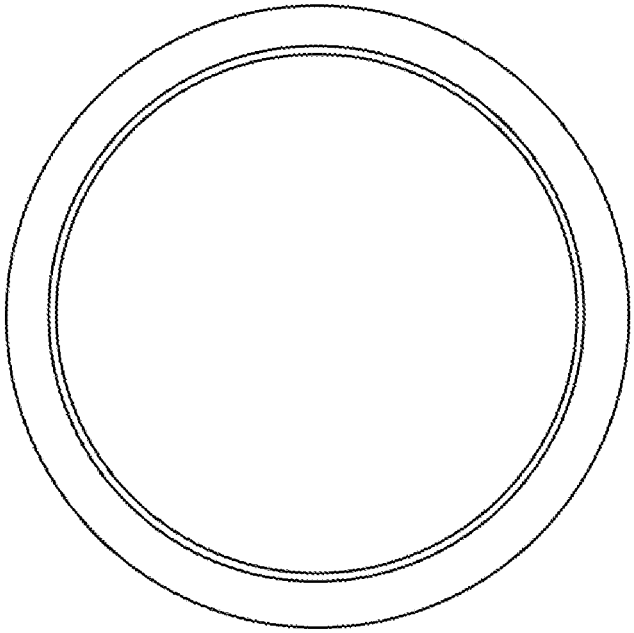
FIG. 7 is a bottom plan view of a dual mouth shotgun can, as contemplated by the present disclosure.
Figure 8:
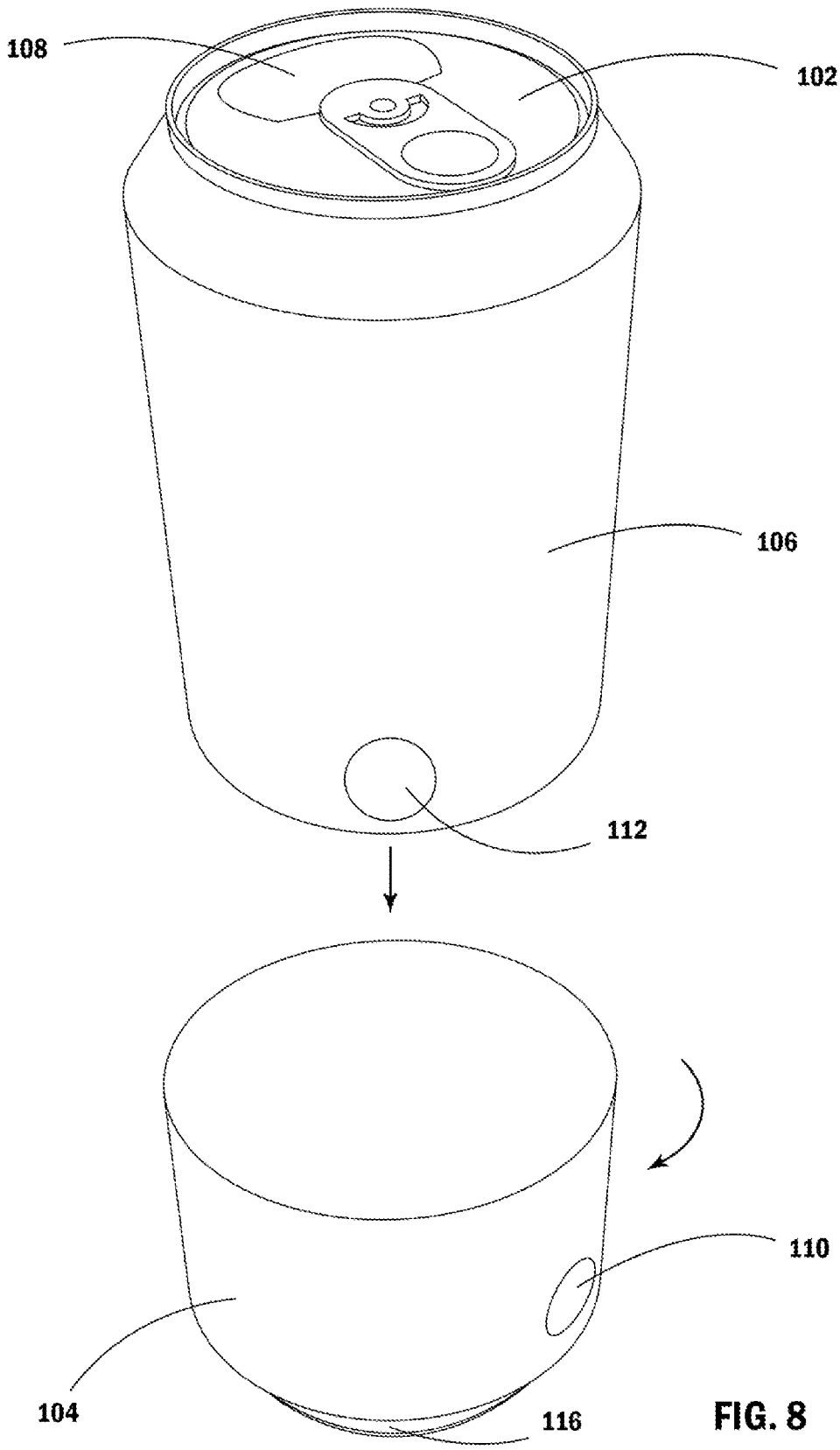
FIG. 8 is an exploded component view of a first embodiment of a dual mouth shotgun can, as contemplated by the present disclosure.
Figure 9:
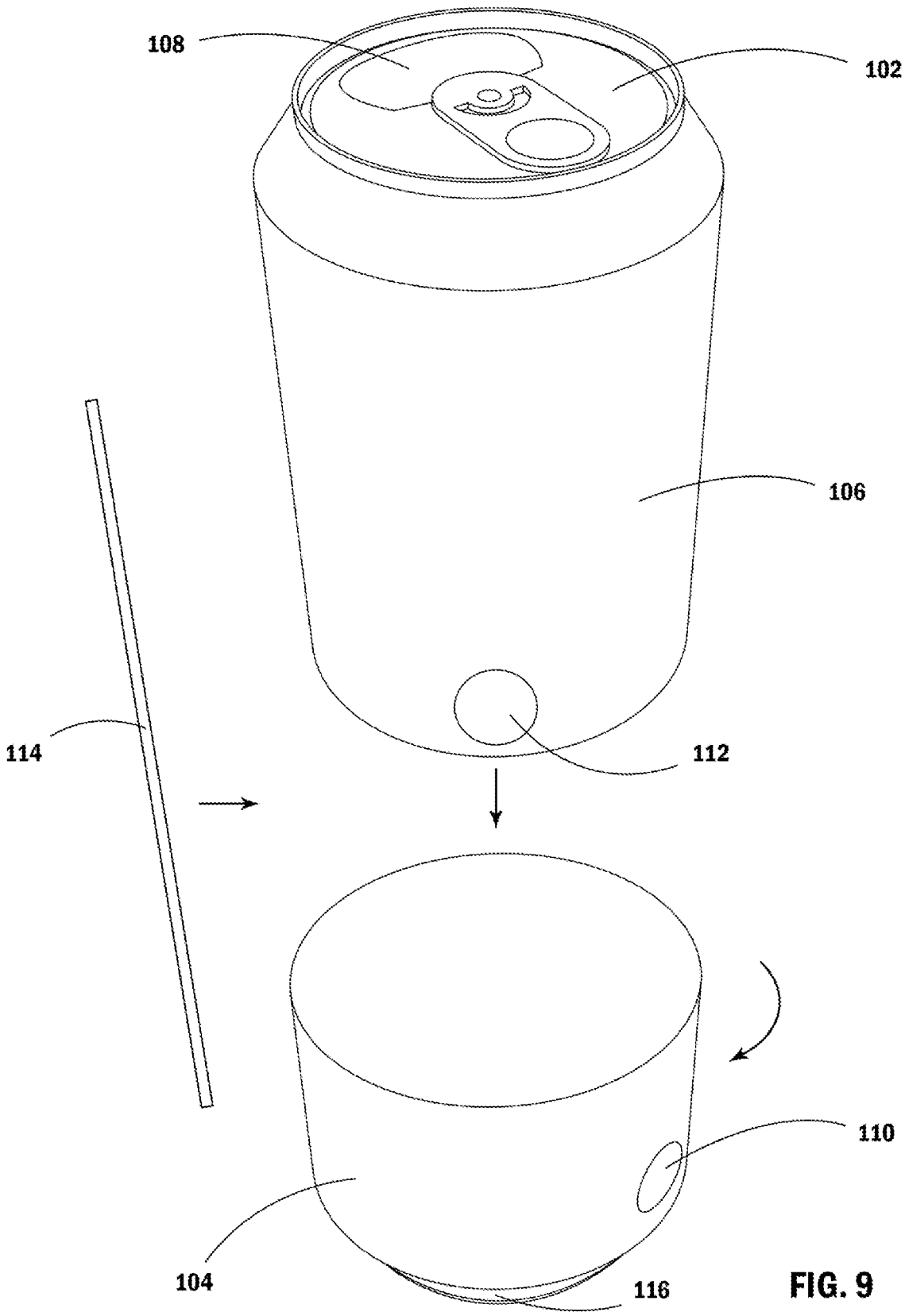
FIG. 9 is an exploded component view of a second embodiment of a dual mouth shotgun can, as contemplated by the present disclosure.
Figure 10:
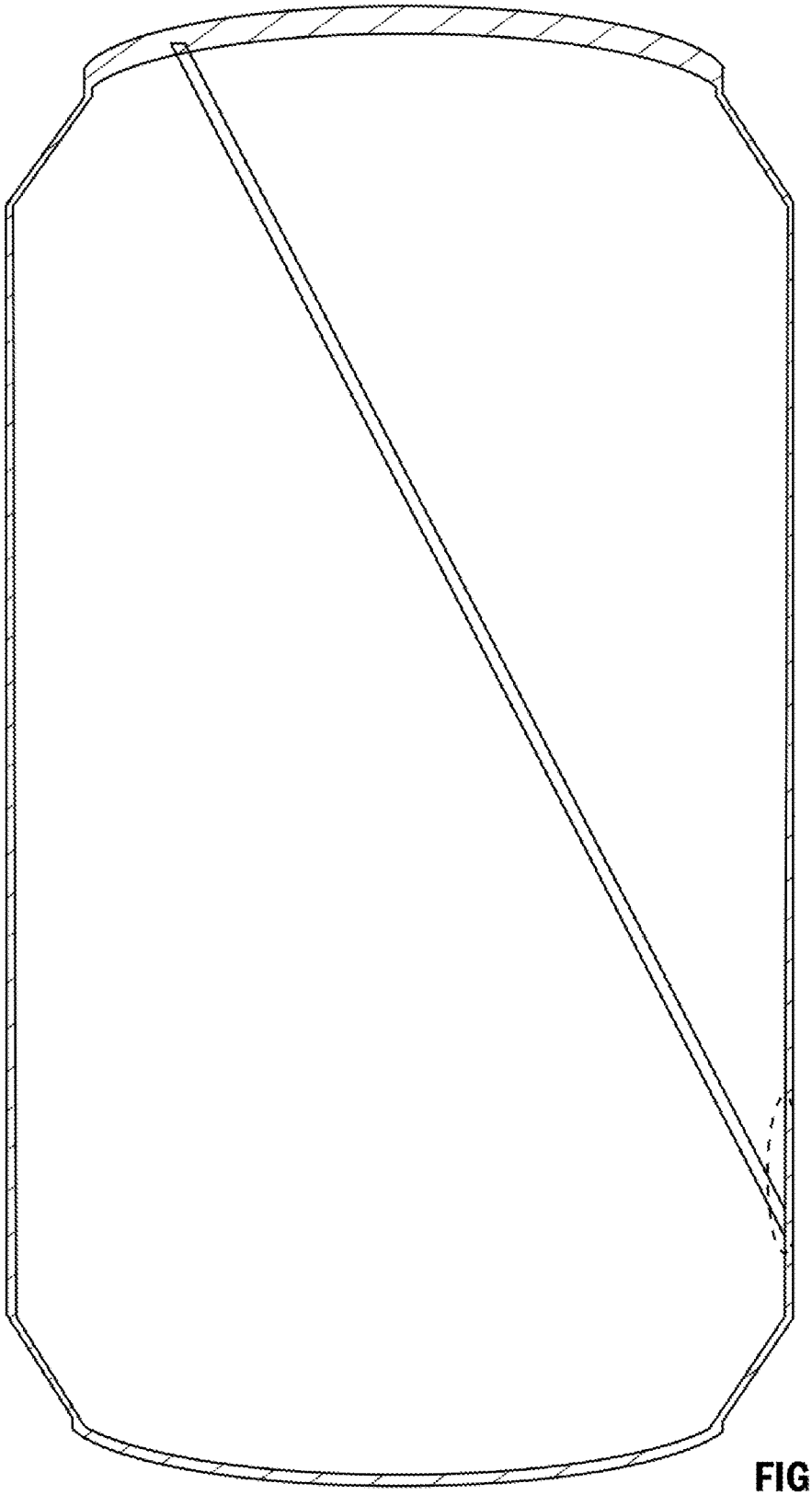
FIG. 10 is a cross-sectional view of a second embodiment of a dual mouth shotgun can, as contemplated by the present disclosure.
Figure 11:
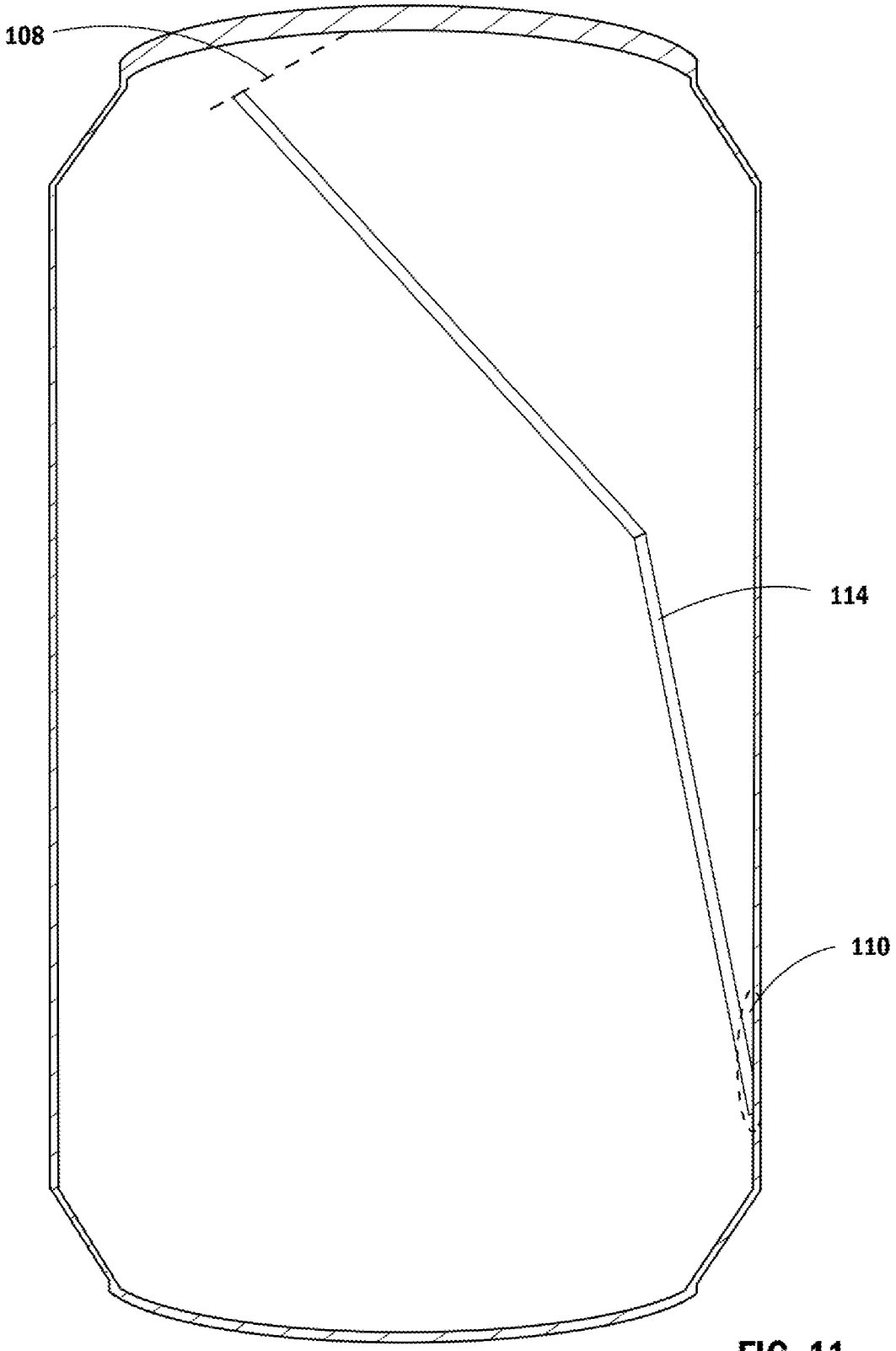
FIG. 11 is a cross-sectional view of a second embodiment of a dual mouth shotgun can, as contemplated by the present disclosure.
Figure 12:
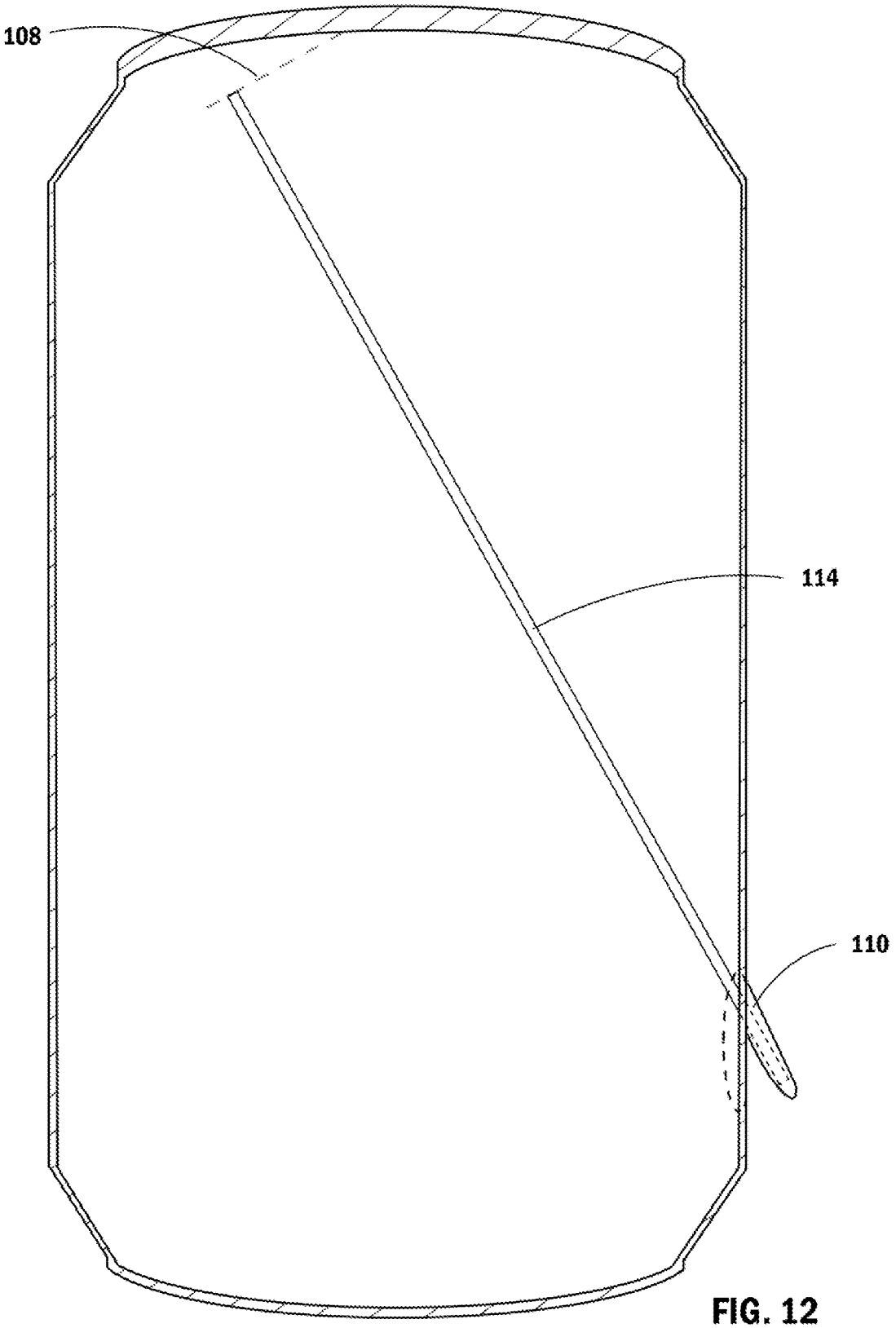
FIG. 12 is a cross-sectional view of a second embodiment of a dual mouth shotgun can, as contemplated by the present disclosure.

The illustrations of FIGS. 1-12 illustrate a dual mouth shotgun can, as contemplated by the present disclosure. The device may comprise, generally, a main body having an upper body 106 and a lower body 104. The upper body 106 may comprise, generally, the upper half of a substantially cylindrical beverage can having a top surface 102, and a perimeter wall. The lower body 104 may comprise, generally, the lower half of a substantially cylindrical beverage can having a perimeter wall and a bottom surface 116. The upper body 106 may fit tightly inside the lower body 104, and the fitting may comprise a water-tight and air-tight seal while allowing for a twisting or rotating range of motion between the upper body 106 and the lower body 104. In this combination the top surface 102 and bottom surface 116 may be orientated substantially parallel to one another, and the perimeter wall may be oriented substantially perpendicular to the top surface 102 and bottom surface 116.

The top surface 102 of the upper body 106 may further comprise a top mouth 108, which may comprise any appropriate openable mouth in the top surface 102 such as, for example, a pull tab or a stay tab. The top mouth 108 may generally comprise an armature or tab that may be leverage against a scored area in the top surface 102 to pop open a mouth or opening in the top surface 102.

The upper body 106 may further comprise a lower mouth 112 which may comprise any appropriate openable mouth in the perimeter wall of the upper body 106. In one embodiment the lower mouth 112 may comprise an opening through the perimeter wall of the upper body 106. In another embodiment the lower mouth 112 may comprise a scored area in the perimeter wall of the upper body 106 that may be popped open to create a mouth or opening in the perimeter wall of the upper body 106.

The lower body 104 may further comprise an outer opening 110 which may comprise any appropriate openable mouth in the perimeter wall of the lower body 104. In one embodiment the outer opening 110 may comprise an opening through the perimeter wall of the lower body 104.

To assemble the dual mouth shotgun can the upper body 106 may be inserted into the lower body 104 to create a water-tight and air-tight seal and substantially create a closed drinks container. The seal may be formed by any appropriate means such as, for example, an o-ring, flat seal, or the like. The lower mouth 112 of the upper body 106 and the outer opening 110 of the lower body 104 may be positioned such that they are at the same height relative to the dual mouth shotgun can, but offset at an angle such that the two openings do not overlap. A user may then twist the upper body 106 relative to the lower body 104 to align the lower mouth 112 with the outer opening 110.

In one embodiment the lower mouth 112 of the upper body 106 may comprise an opening and the outer opening 110 of the lower body 104 may comprise an opening. In such an embodiment the twisting of the upper body 106 relative to the lower body 104 may align the two openings and allow for the free flow of air into the dual mouth shotgun can.

In one embodiment the lower mouth 112 of the upper body 106 may comprise a scored area and the outer opening 110 of the lower body 104 may comprise an opening. In such an embodiment the twisting of the upper body 106 relative to the lower body 104 may align the two openings. A user may then apply leverage to the lower mouth 112 to pop open the scored area to create a mouth and allow for the free flow of air into the dual mouth shotgun can.

In one embodiment the dual mouth shotgun can may further comprise a pushrod 114. The pushrod 114 may be any appropriate rod having a first end attached to the top mouth 108 and a second end attached to the lower mouth 112. The lower mouth 112 of the upper body 106 may comprise a scored area and the outer opening 110 of the lower body 104 may comprise an opening. In such an embodiment the twisting of the upper body 106 relative to the lower body 104 may align the two openings. A user may then apply leverage to the top mouth 108 to pop open the scored area of the top surface 102, and this action may push the pushrod 114 against the lower mouth 112, popping it open simultaneously to create a mouth and allow for the free flow of air into the dual mouth shotgun can. In such an embodiment if the user does not twist the upper body 106 relative to the lower body 104 to align the two openings, the perimeter wall of the lower body 104 may prevent the opening of the lower mouth 112, and the opening of the top mouth 108 would cause the pushrod 114 to bend or collapse so that the dual mouth shotgun can may only have one open mouth, as desired.

The dual mouth shotgun can may vary in size and capacity as desired. By way of example, a beverage can in Australia may be standardized to hold 375 milliliters (ml) of fluid. A beverage can in China, on the other hand, may be standardized to hold 330 ml of fluid. In the United States the most common sizes of beverage cans are approximately 355 ml and 4.83 inches in height and 2.6 inches in diameter.

The dual mouth shotgun can may vary in materials composition and combinations as desired. By way of example, most beverage cans manufactured in the United States are made of aluminum, whereas in some parts of Europe and Asia approximately 55 percent of beverage cans are made of steel and 45 percent are aluminum alloy. Steel cans often have a top surface made of aluminum. The aluminum used in the United States and Canada are alloys containing 92.5% to 97% aluminum, <5.5% magnesium, <1.6% manganese, <0.15% chromium, and some trace amounts of iron, silicon, and copper.

The dual mouth shotgun can may be manufactured in any appropriate manner. By way of example, most beverage cans may be generally produced through a mechanical cold forming process that starts with punching a flat blank from very stiff cold-rolled metal sheet. This sheet may be an aluminum alloy with about 1% manganese and 1% magnesium to give it strength and formability. The flat blank may be first formed into a cup about three inches in diameter. This cup may then then pushed through a different forming process called ironing which forms the can. The bottom of the can may also be shaped at this time. The malleable metal may deform into the shape of an open-top can. Plain top surfaces may be stamped from a coil of aluminum alloy and transferred to another press that converts them to easy-open ends. This press is known as a conversion press and may form an integral rivet button in the lid and score the opening, while concurrently forming the tabs in another die from a separate strip of aluminum.

The dual mouth shotgun can may be substantially constructed of any suitable material or combination of materials, but typically is constructed of a resilient material or combination of materials such that the device is resistant to damage as a result of compression, twisting, heating, or submersion in water. As an example, and without limiting the scope of the present invention, various exemplary embodiments of the dual mouth shotgun can may be substantially constructed of one or more materials of aluminum, steel, metal alloys, plastic, acrylic, polycarbonate, brass, fiberglass, carbon fiber, or combinations thereof. In some embodiments the various components of the device may be coated, lined, or otherwise insulated to prevent contamination of the device. In one embodiment the material of construction may vary from one component to the next within the system.

In one embodiment the dual mouth shotgun can may comprise a resilient material of construction that either comprises a material having antimicrobial properties or comprises a layering of antimicrobial material or coating. Antimicrobial properties comprise the characteristic of being antibacterial, biocidal, microbicidal, anti-fungal, antiviral, or other similar characteristics, and the oligodynamic effect, which is possessed by copper, brass, silver, gold, and several other metals and alloys, is one such characteristic. Copper and its alloys, in particular, have exceptional self-sanitizing effects. Silver also has this effect, and is less toxic to users than copper. Some materials, such as silver in its metallic form, may require the presence of moisture to activate the antimicrobial properties.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

I claim:

1. A dual mouth shotgun can, comprising:

a pushrod;

an upper body; and a lower body;

wherein said upper body comprises a top surface and a perimeter wall;

wherein said top surface further comprises a top mouth;

wherein said perimeter wall of said upper body further comprises a lower mouth;

wherein said lower body comprises a bottom surface and a perimeter wall;

wherein said perimeter wall of said lower body further comprises an outer opening;

wherein said upper body is inserted into said lower body to create a closed fluid container;

wherein said upper body is twistably attached to said lower body;

wherein said lower mouth is aligned with said outer opening when said upper body is twisted relative to said lower body;

wherein said lower mouth comprises a scored area in said perimeter wall of said upper body;

wherein said outer opening comprises an opening through said perimeter wall of said lower body;

wherein a first end of said pushrod is attached to said top mouth; and wherein a second end of said pushrod is attached to said lower area.

* * * * *